US011674488B2

(12) United States Patent
Escalante et al.

(10) Patent No.: US 11,674,488 B2
(45) Date of Patent: Jun. 13, 2023

(54) FLUID INJECTOR MOUNTING CUP

(71) Applicants: Robert Bosch GmbH, Stuttgart (DE); Emmanuel Alfonso Guzman Escalante, San Luis Potosí (MX); Josué Israel Chávez Mendoza, San Luis Potosí (MX); John Casari, Manchester, MI (US)

(72) Inventors: Emmanuel Alfonso Guzman Escalante, San Luis Potosí (MX); Josué Israel Chávez Mendoza, San Luis Potosí (MX); John Casari, Manchester, MI (US)

(73) Assignee: Robert Bosch GmbH, Stuttgart (DE)

( * ) Notice: Subject to any disclaimer, the term of this patent is extended or adjusted under 35 U.S.C. 154(b) by 38 days.

(21) Appl. No.: 17/611,608

(22) PCT Filed: May 22, 2020

(86) PCT No.: PCT/US2020/034203
§ 371 (c)(1),
(2) Date: Nov. 16, 2021

(87) PCT Pub. No.: WO2020/242937
PCT Pub. Date: Dec. 3, 2020

(65) Prior Publication Data

US 2022/0243692 A1 Aug. 4, 2022

Related U.S. Application Data

(60) Provisional application No. 62/853,797, filed on May 29, 2019.

(51) Int. Cl.

| | |
|---|---|
| ***F02M 61/14*** | (2006.01) |
| ***F02M 55/02*** | (2006.01) |
| ***F02M 61/16*** | (2006.01) |

(52) U.S. Cl.
CPC ..... *F02M 61/14* (2013.01); *F02M 55/02* (2013.01); *F02M 61/16* (2013.01)

(58) Field of Classification Search
CPC ..... F02M 61/14; F02M 61/16; F02M 61/168; F02M 55/02; F02M 2200/803; F02M 2200/853; F02M 2200/8015
(Continued)

(56) References Cited

U.S. PATENT DOCUMENTS

| | | | |
|---|---|---|---|
| 4,295,452 | A | 10/1981 | Lembke et al. |
| 6,019,089 | A | 2/2000 | Taylor et al. |

(Continued)

FOREIGN PATENT DOCUMENTS

| | | | |
|---|---|---|---|
| EP | 1482169 | A2 | 12/2004 |
| EP | 3470662 | A1 | 4/2019 |
| WO | 2018069336 | A1 | 4/2018 |

OTHER PUBLICATIONS

Intellectual Property India Patent Office Examination Report for Application No. 202117053372 dated Apr. 29, 2022 (7 pages including English translation).

(Continued)

*Primary Examiner* — Hai H Huynh
(74) *Attorney, Agent, or Firm* — Michael Best & Friedrich LLP

(57) ABSTRACT

A fuel injector cup includes a body having a first opening configured to receive fuel into the body and a second opening configured to receive a fuel injector for dispensing fuel. The cup further includes a mounting flange coupled with the body and extending therefrom, the mounting flange configured to be connected to a support surface to secure the cup to the support surface. The cup also includes a locating member coupled with at least one of the body or the mounting flange, the anti-rotation member configured to (Continued)

engage the fuel injector when received in the body and to orient and prevent rotation of the fuel injector relative to the body.

19 Claims, 6 Drawing Sheets

(58) Field of Classification Search
USPC ..... 123/470
See application file for complete search history.

(56) References Cited

U.S. PATENT DOCUMENTS

| | | | |
|---|---|---|---|
| 6,321,719 | B1 | 11/2001 | Schwegler |
| 6,543,421 | B2 | 4/2003 | Lorraine et al. |
| 6,651,628 | B2 | 11/2003 | Nally |
| 6,874,477 | B1 | 4/2005 | Lorraine et al. |
| 6,901,913 | B1 | 6/2005 | Tsuchiya et al. |
| 7,159,570 | B2 | 1/2007 | Zdroik |
| 7,228,846 | B2 | 6/2007 | Kilgore |
| 7,516,734 | B2 | 4/2009 | Tominaga et al. |
| 7,802,560 | B2 | 9/2010 | Lysinger et al. |
| 7,810,471 | B2 | 10/2010 | Zdroik |
| 7,886,717 | B2 | 2/2011 | Rettig et al. |
| 8,424,509 | B1 | 4/2013 | Davis |
| 9,631,594 | B2 | 4/2017 | Harvey et al. |
| 9,957,938 | B2 | 5/2018 | Roseborsky et al. |
| 9,982,642 | B2 | 5/2018 | Matteini et al. |
| 10,125,733 | B1 | 11/2018 | Mizuba et al. |
| 10,190,557 | B2 * | 1/2019 | Roseborsky ..... F02M 63/0225 |
| 10,934,984 | B1 * | 3/2021 | Roseborsky ..... F02M 51/005 |
| 2007/0266996 | A1 | 11/2007 | Zdroik et al. |
| 2014/0123952 | A1 * | 5/2014 | Yasuda ..... F02M 61/16 123/470 |
| 2014/0261332 | A1 * | 9/2014 | Ramamurthy ..... F02M 61/14 123/470 |
| 2017/0096977 | A1 | 4/2017 | Di Domizio et al. |
| 2017/0248108 | A1 | 8/2017 | Di Domizio et al. |
| 2018/0135582 | A1 | 5/2018 | Puccini et al. |
| 2018/0372045 | A1 | 12/2018 | Oh et al. |

OTHER PUBLICATIONS

International Search Report and Written Opinion for Application No. PCT/US2020/034203 dated Jul. 21, 2020 (12 pages).

* cited by examiner

FLUID INJECTOR MOUNTING CUP

CROSS REFERENCE TO RELATED APPLICATIONS

This application is a 371 National Phase of PCT Application No. PCT/US2020/034203 filed May 22, 2020, which claims priority to U.S. Provisional Patent Application No. 62/853,797, filed May 29, 2019, the entire contents of which are hereby incorporated by reference herein in their entirety.

RELATED APPLICATIONS

This application claims the benefit of U.S. Provisional Patent Application No. 62/853,797 filed May 29, 2019, the entire content of which is hereby incorporated by reference herein.

BACKGROUND

The present invention relates to fuel injection systems, and more specifically to cups or bushings used to mount and constrain fuel injectors in fuel injection systems.

SUMMARY

In one embodiment, the invention provides a fuel injector cup including a body having a first opening configured to receive fuel into the body, and a second opening configured to receive a fuel injector for dispensing fuel. The cup further includes a mounting flange coupled with the body and extending therefrom, the mounting flange configured to be connected to a support surface to secure and locate the cup to the support surface. The cup also includes a locating member coupled with at least one of the body or the mounting flange, the locating member configured to engage the fuel injector when received in the body and to radially orient the injector for function and prevent rotation of the fuel injector relative to the body.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
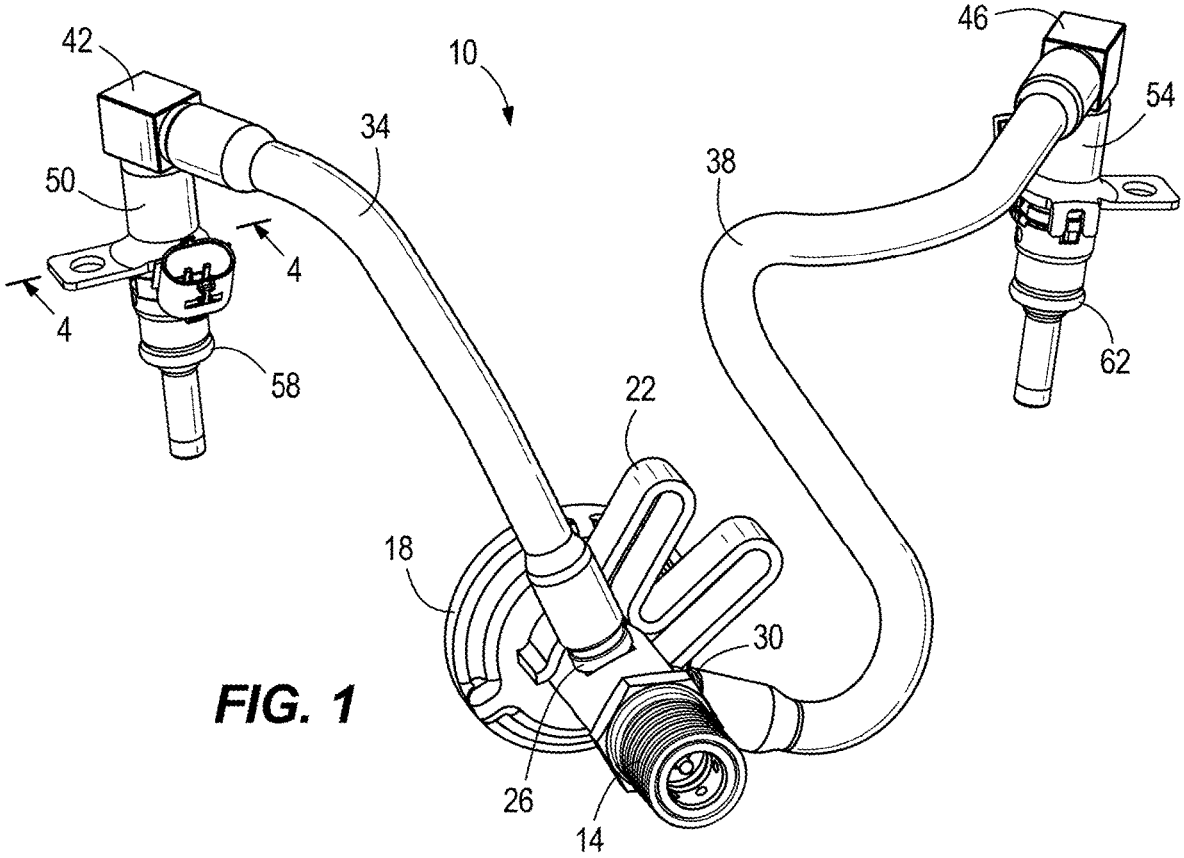
FIG. 1 is a perspective view of a fuel injection system containing injector cups embodying the invention.

FIG. 1 illustrates a fuel system 10 that can be used to provide fuel to an internal combustion engine. The illustrated fuel system 10 is designed to be used on a motorcycle, however, other applications are also contemplated. The fuel system 10 includes a manifold 14 for receiving and distributing fuel from a fuel supply. A damper 18 communicates with the manifold 14 to absorb pressure pulsations. A mounting bracket 22 is coupled with the manifold 14 for securing the manifold 14 to a support surface (e.g., a throttle body housing).

Figure 5:
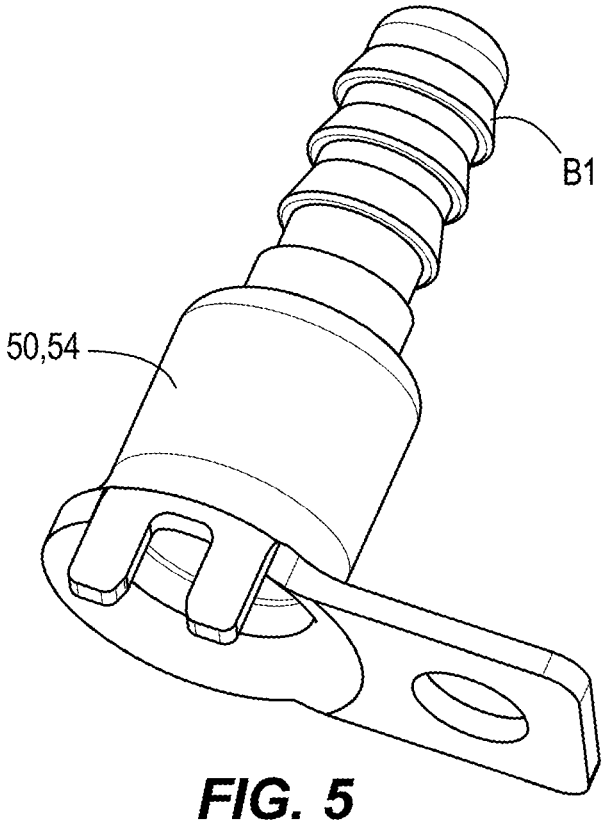
FIG. 5 is an alternative embodiment with the injector cup coupled to a straight hose barb.
Figure 6:
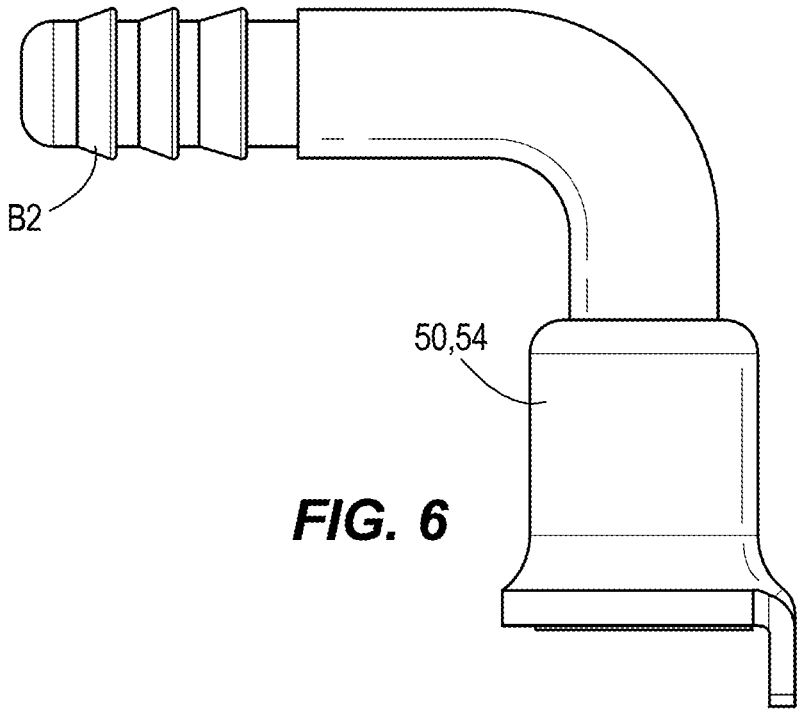
FIG. 6 is another alternative embodiment with the injector cup coupled to a bent hose barb.
Figure 7:
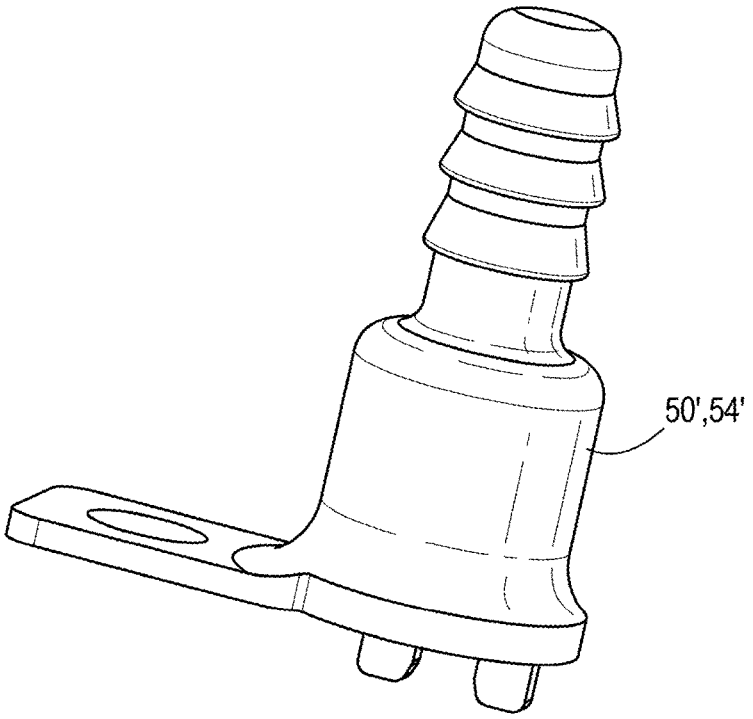
FIG. 7 is yet another alternative embodiment with the injector cup integrally formed as one piece with a straight hose barb.

The illustrated manifold 14 includes two outlet ports 26, 30. In other embodiments, more outlet ports may be present. Hoses 34, 38 are coupled to the respective outlet ports 26, 30 to transfer fuel away from the manifold 14. The ends of the hoses 34, 38 opposite the manifold 14 connect to respective barb blocks 42, 46. Each barb block 42, 46 includes a hose barb (not shown) over which the end of the respective hose 34, 48 is secured. Fuel is thereby transported from the manifold 14, through the hoses 34, 38, to the barb blocks 42, 46. Fuel or fluid injector cups 50, 54 are coupled with the respective barb blocks 42, 46, and each injector cup 50, 54 receives therein a respective fuel injector 58, 62 that dispenses fuel into an air/fuel mixture manifold, or in other embodiments, into a cylinder head. Fuel passes through the barb blocks 42, 46 and into the injectors 58, 62 via the injector cups 50, 54. In other embodiments, barb blocks 42, 46 could be replaced by barbs without any block structure coupled thereto. For example, FIG. 5 illustrates a straight hose barb B1 coupled to the cup 50, 54, and FIG. 6 illustrates a bent (e.g., 90 degree) hose barb B2 coupled to the cup 50, 54. The hose barbs B1 and B2 can be separate parts directly secured to the cups 50, 54. In yet other embodiments, the hose barb could be integrally formed as one piece with the cup 50', 54', as shown in FIG. 7.

Figure 2:
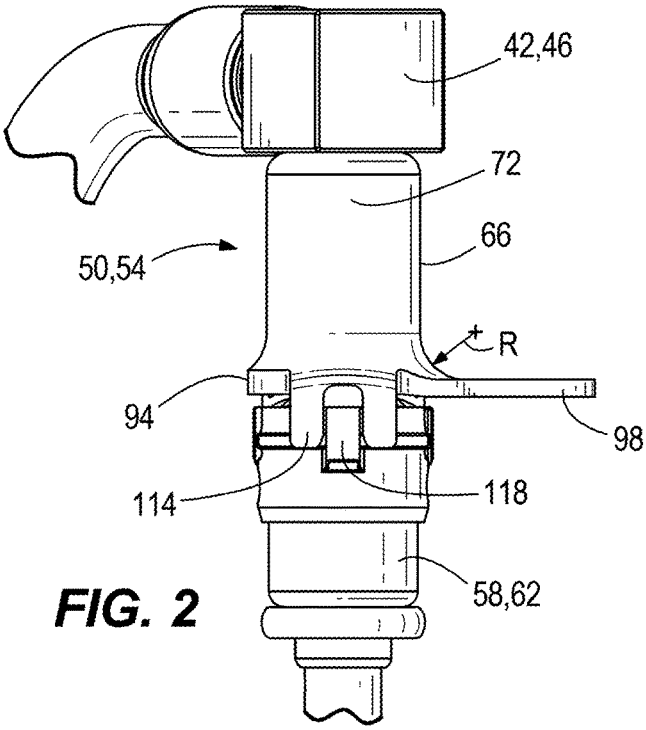
FIG. 2 is an enlarged, partial perspective view of FIG. 1 showing one injector cup.
Figure 4:
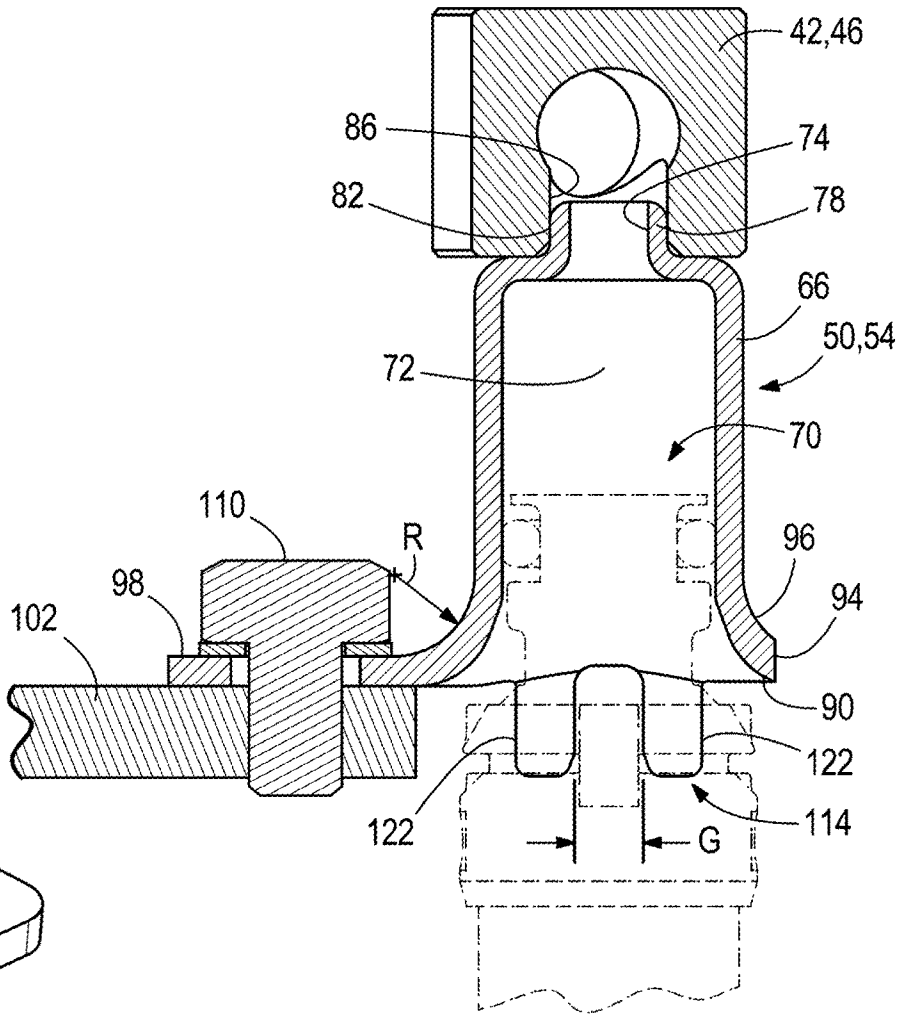
FIG. 4 is a section view of the injector cup engaged with a barb block.
Figure 3:
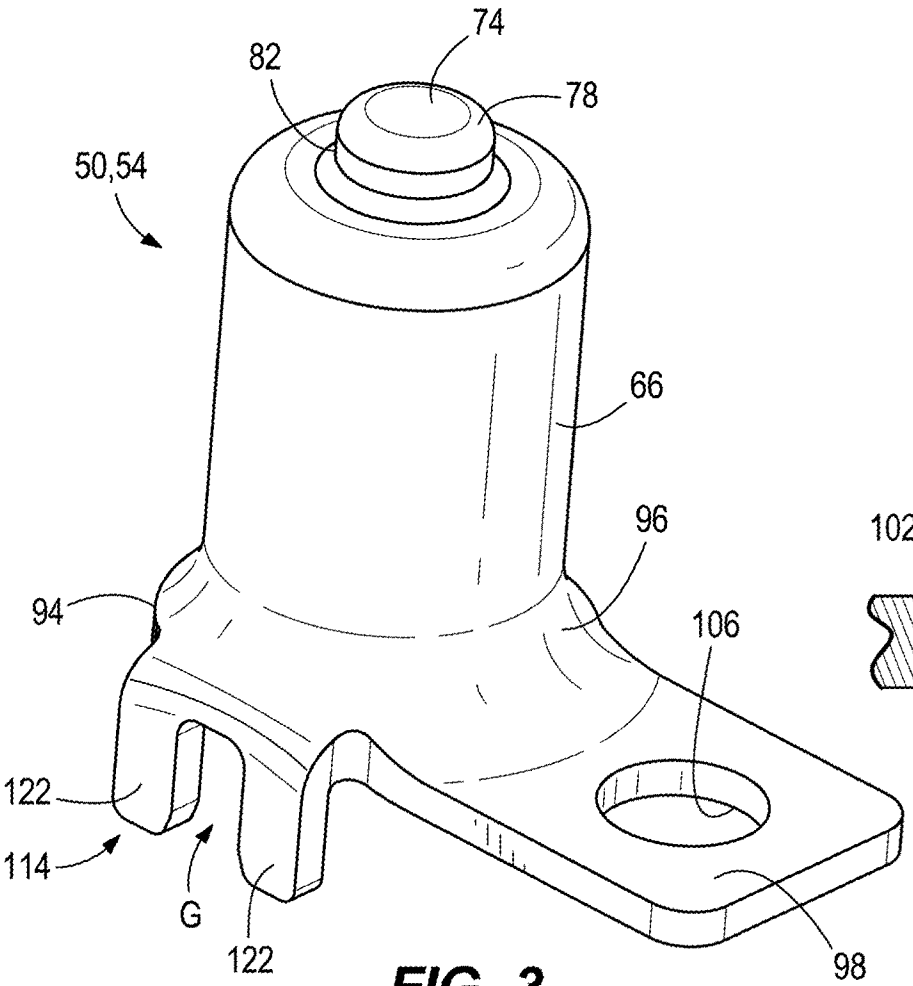
FIG. 3 is a perspective view of the injector cup of FIGS. 1 and 2.

Referring now to FIGS. 2-4, each injector cup 50, 54 includes a cup portion or body 66, that in the illustrated embodiment is generally cylindrical and defines a cavity 70 (see FIG. 4) for receiving an end of the fuel injector 58, 62. The body 66 defines a longitudinal axis 72, which is the same as the axis defined by the bore of the cavity. The body 66 includes a first opening 74 that communicates with the barb block 42, 46 to allow entry of fuel into the cavity 70. In the illustrated embodiment, the first opening 74 is defined at a first longitudinal end 78 of the body 66 that includes a reduced diameter portion 82 configured to be received into a mating opening 86 in the barb block 42, 46. The reduced diameter portion 82 can be brazed or otherwise secured to the barb block 42, 46.

The body 66 further includes a second opening 90, which in the illustrated embodiment is at a second longitudinal end 94 of the body 66 opposite the first longitudinal end 78. The second opening 90 is configured to receive an end of the fuel injector 58, 62 therein for dispensing fuel present in the body 66. In the illustrated embodiment, the first opening 74 has a diameter that is smaller than a diameter of the second opening 90 and that is smaller than a diameter of the cavity 70. The illustrated cup 50, 54 further includes an optional tapered or flared-out portion 96 adjacent the second opening 90 to facilitate installation of the injector 58, 62 into the cavity 70. The illustrated tapered portion 96 extends around the entire circumference of the body 66, but in other embodiments, this need not be the case.

The injector cups 50, 54 each also include a mounting flange 98 coupled with the body 66 and extending therefrom. The mounting flange 98 is configured to be connected to a support surface 102 (see FIG. 4) to secure the cup 50, 54 to the support surface 102, which can be a portion of a throttle body housing, cylinder head, or other suitable component. The illustrated mounting flange 98 includes an aperture 106 that receives a fastener 110 (see FIG. 4) that secures the mounting flange 98, and thereby the cup 50, 54, to the support surface 102. The illustrated mounting flange 98 is planar and rectangular, and extends in a plane perpendicular to the longitudinal axis 72 of the body 66. However, in other embodiments, the mounting flange 98 can be configured with other geometries depending upon the configuration of the mounting surface to which the mounting bracket 98 will be mounted. Furthermore, in the illustrated embodiment, the mounting flange 98 is positioned immediately adjacent the second opening 90 and extends from a distal end of the tapered portion 96. The tapered portion 96 and its transition into the mounting flange 98 defines a compound or multi-plane curvature in the sense that the tapered portion 96 is formed with a radius R (e.g., 4.15 mm) while also extending circumferentially around the 360 degrees of the body 66. This arrangement generates area moments which, due to the integrated compound curvature shape, efficiently transmit system forces to the support surface 102. In some other embodiments, the mounting flange 98 can alternatively extend from other portions of the body 66.

Figure 4A:
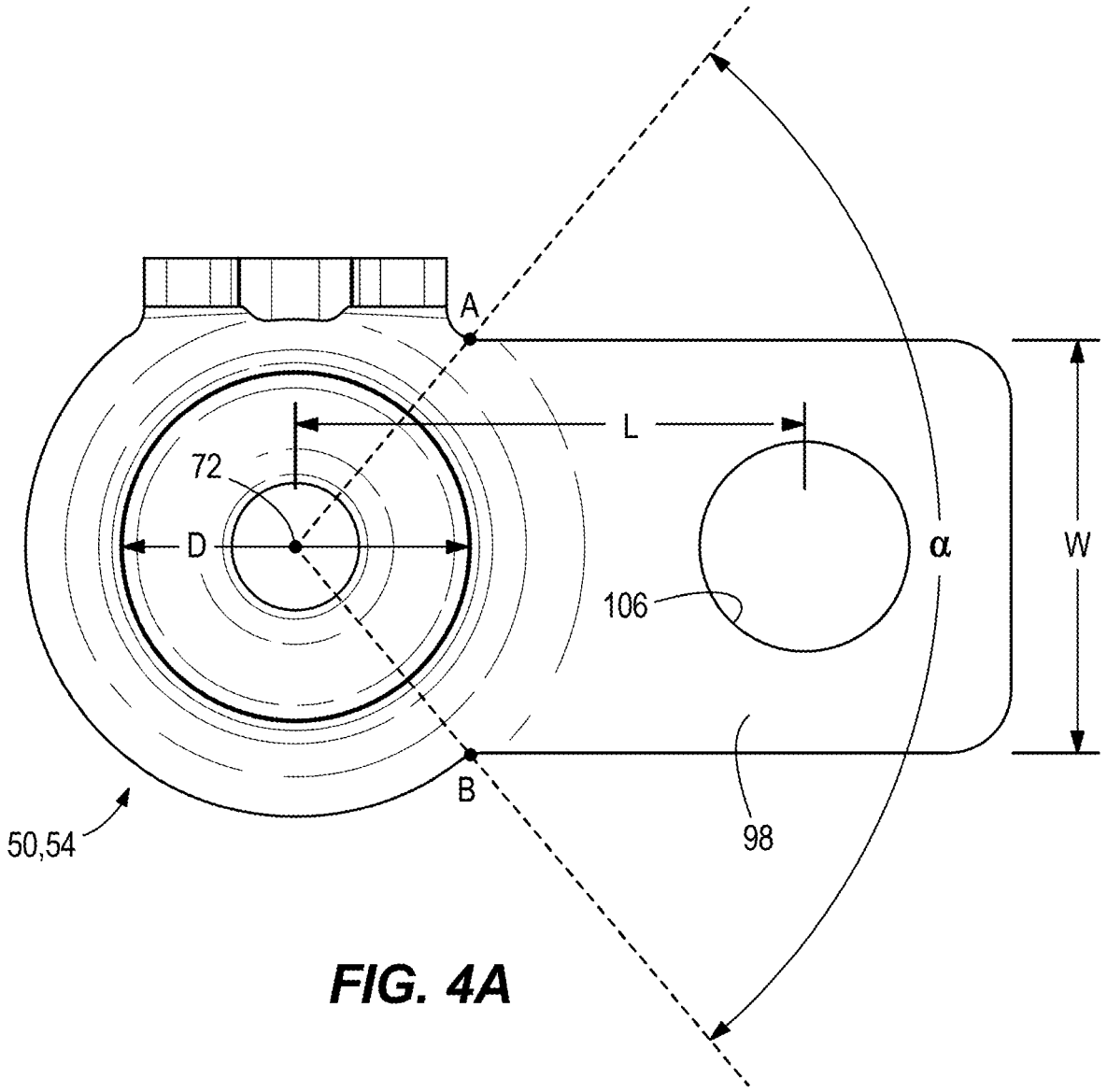
FIG. 4A is a bottom view of the injector cup of FIGS. 1 and 2.
Figure 9:
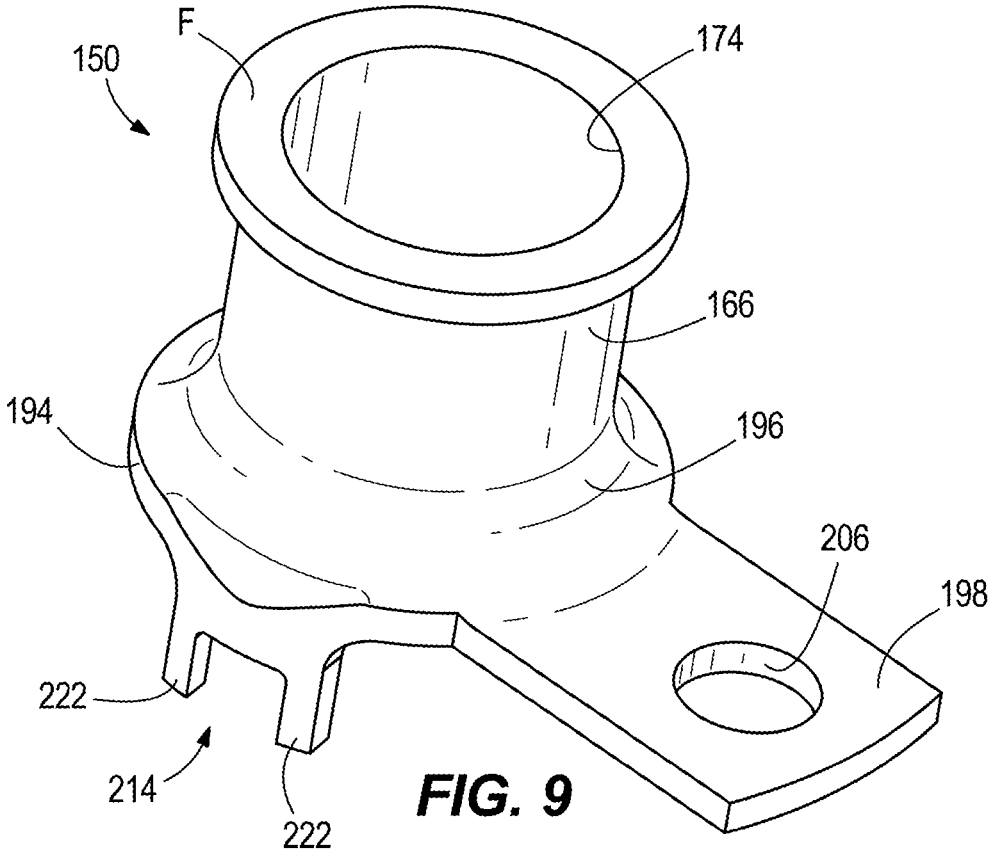
FIG. 9 is a perspective view of an alternative embodiment of an injector cup having a flange for mounting to a conventional fuel rail.
Figure 9A:
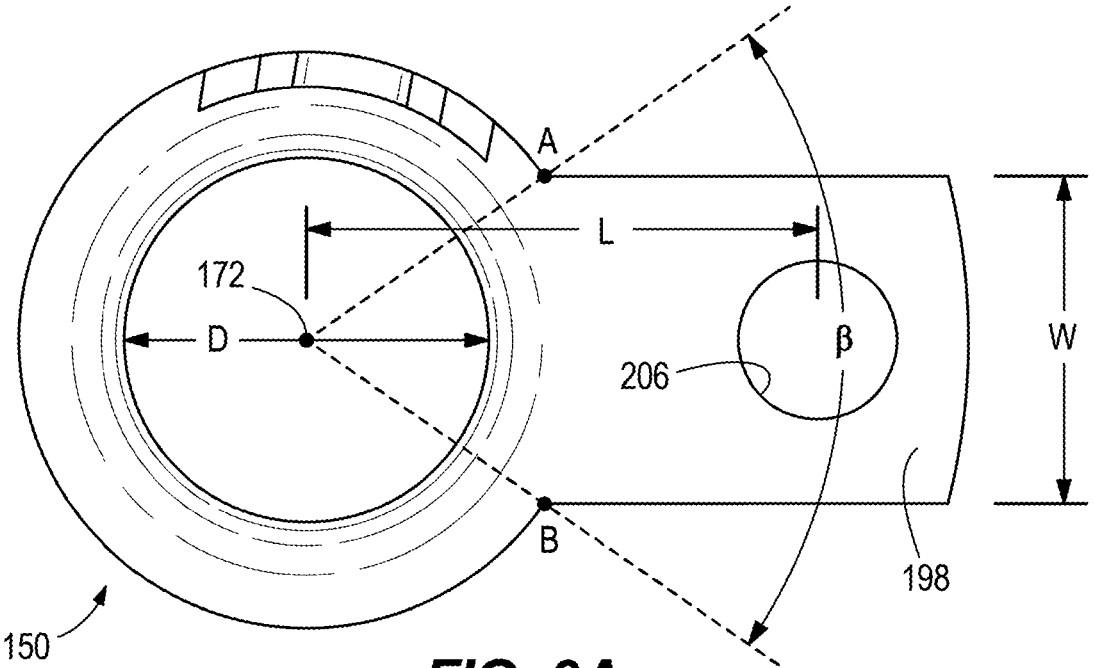
FIG. 9A is a bottom view of the injector cup of FIG. 9.

In the illustrated embodiment, a ratio of the cavity diameter to the radius R of the tapered portion 96 at the transition location into the mounting flange 98 can range from 2.6 to 3.3. This ratio range has been found to be the practical limit for formability of the one-piece cups 50, 54. For example, a cup 50 with a cavity diameter D of 10.9 mm might have a radius R of the tapered portion 96 adjacent the mounting flange of about 4.15 mm, and a cup 150 (see FIGS. 9 and 9A) with cavity diameter D of 13.8 mm might also have a radius R of the tapered portion 96 adjacent the mounting flange of about 4.15 mm. Furthermore, as shown in FIG. 4A, when the ratio is 2.6, an arc angle $\alpha$ of 95-100 degrees is measured between a first line taken from the longitudinal axis 72 of the cavity 70 to a point A where the tapered portion 96 meets a first edge of the mounting flange 98, and a second line taken from the longitudinal axis 72 of the cavity 70 to a point B where the tapered portion 96 meets a second edge of the mounting flange 98. This arc angle results in the mounting flange 98 having the desired width W of 12 to 13 mm. As shown in FIG. 9A, when the ratio is 3.3, an arc angle $\beta$ of 65-70 degrees is measured between a first line taken from the longitudinal axis 172 of the cavity 70 to a point A where the tapered portion 196 meets a first edge of the mounting flange 198, and a second line taken from the longitudinal axis 172 of the cavity 70 to a point B where the tapered portion 196 meets a second edge of the mounting flange 198. Again, this arc angle results in the mounting flange 198 having the desired width W of 12 to 13 mm. The injector cups 50, 54 each further include an injector locating member 114 coupled with at least one of the body 66 or the mounting flange 98. As illustrated, the locating member 114 is coupled to the body 66 immediately adjacent the second opening 90 and extends from a distal end of the tapered portion 94 away from the body 66. However, other locations for the locating member 114 (e.g., on the edge surfaces of the flange 98) are also contemplated. The locating member 114 is configured to engage the fuel injector 58, 62 when received in the body 66 and to rotationally orient the injector for function and prevent rotation of the fuel injector 58, 62 relative to the body 66. In other words, the locating member 114 facilitates installing the injector 58, 62 in the proper rotational orientation relative to the cups 50, 54, and once installed, anti-rotates the injector 58, 62. As best seen in FIG. 2, the injector 58, 62 includes a tab or projection 118 operable as a rotational locator and configured to engage with the locating member 114. The projection 118 can be formed on the housing of the injector 58, 62. The illustrated locating member 114 includes at least one, and as illustrated, two projections 122 extending in a direction parallel to the longitudinal axis 72 of the body 66 and away from the second opening 90. The two projections 122 are spaced apart from one another to define a gap G therebetween. The gap G is configured to receive the projection 118 of the fuel injector 58, 62, thereby circumferentially orienting and preventing rotation of the fuel injector 58, 62 when it is received and housed in the cavity 70. Of course, other configurations of the locating member 114 can be used (e.g., parallel to the flange 98) to mate with different geometry on the injectors 58, 62.

In the illustrated embodiment, the locating member 114 is spaced circumferentially around the body 66 about ninety degrees from the mounting flange 98, but in other embodiments, other circumferential orientations can be chosen. Furthermore, in some embodiments, the locating member 114 could be integrally formed into or as part of the mounting flange 98.

The illustrated injector cups 50, 54 are integrally formed as one piece, and are made from stainless steel or other suitable materials. They can be manufactured in any suitable manner. For example, the initial metal form can be a stamped, planar sheet of stainless steel that is then formed in a progressive die to create the desired geometry for the body 66. The mounting flange 98 can be cut to form via trim die punching or other suitable methods. Likewise, the projections 122 of the locating member 114 can be trim die punched or otherwise formed, and then bent away from the second opening 90 to achieve the illustrated configuration. Other forms of manufacture can include forming the cups 50, 54 of compressed sintered powder metal, subtractive machining, casting, injection molding, and etc. or by 3D additive printing with laser or binder fusing, and can integrate the barbed fitting, SAE quick connect, or other such connection as needed to integrate the cup into a system.

In prior art injection systems, rotationally-orienting and anti-rotation features are often separate parts (e.g., separate clips) that must be removably secured to the injector cups. These clips may also help axially constrain the injectors in the cups. Furthermore, prior art injector cups typically do not include any mounting flange. Instead, it is conventional practice to include mounting flanges on a fuel rail to which multiple injector cups are secured. By including a mounting flange 98 as part of the injector cup 50, 54, the injectors 58, 62 in their respective injector cups 50, 54 can be independently positioned and mounted in a given engine configuration without regard to where the larger fuel rail, or in this case, the manifold 14 is mounted. This reduces the precision of the assembly positions for installation. Also, by mounting the cups 50, 54 directly to the support surface 102 via the mounting flange 98, the injectors 58, 62 are secured and retained in the cups 50, 54, without requiring a separate feature to secure and retain the injectors 58, 62 in the cups 50, 54. This arrangement reduces the space needed for locating the cup 50,54 and injector 58, 62.

This reduced space, or package volume, can be quantified as follows. For the cup 50, which has a cavity bore diameter of 10.9 mm, the smallest rectangular volume or box (i.e., length×width×height of a box) in which the cup 50 (including the mounting flange 98 and the locating member 114) can be completely contained measures 14,590 $mm^3$. A packaging ratio, which is defined as a ratio of this smallest box volume to the cavity bore diameter, is 1,338 $mm^3$/mm. For the cup 150 of FIGS. 9 and 9A, which has a cavity bore diameter of 13.8 mm, the smallest rectangular volume or box in which the cup 150 (including the mounting flange 198 and the locating member 214) can be completely contained measures 17,965 $mm^3$. A packaging ratio of this smallest box volume to the cavity bore diameter is 1,302 $mm^3$/mm. Packaging ratios on this order (e.g., from 1,300 $mm^3$/mm to 1,400 $mm^3$/mm, or from 1,300 $mm^3$/mm to 1,350 $mm^3$/mm) mean that the cups 50, 54, 150, with integral mounting and injector locating features, are ideally suited for today's engine applications in which minimizing the size and weight of components within the engine compartment is important. It is believed that the closest cups on the market today, which don't even have integral mounting and injector locating features, would have packaging ratios that are two or three times that of the cups 50, 54, 150.

Another manner of quantifying the reduced package size is by looking at a distance L from the longitudinal axis 72, 172 to the centerline of the aperture 106, 206. As seen in FIGS. 4A and 9A, this distance L ranges from 16 mm to 19.5 mm. In other words, the cups 50, 54, 150, each with their integral mounting flanges, define a distance L that is less than 20 mm, thereby providing a small part that is well suited for use in the small envelopes of today's engine compartments. The short distance L (also known as the load path) also reduces the bending moment so the cups 50, 54, 150 can accommodate the loading forces generated by the injectors. In the illustrated embodiment, a mounting distance ratio, which is defined as a ratio of the distance L to the cavity bore diameter, ranges from 1.40 to 1.47.

In other words, this configuration facilitates flexibly, independently, and remotely positioning the injectors 58, 62 relative to a fuel manifold 14, with a minimal number of separate parts and in a small package space or envelope. In some regards, each barb block 42, 46 acts as a single-injector fuel rail, in that only one cup 50, 54 is mounted into a respective barb block 42, 46. However, the mounting flange 98 is not part of the barb blocks 42, 46, but instead is part of the injector cups 50, 54. This arrangement produces short load paths for distributing loads from the system to the mounting surface with reduced material and fastener sizes. In alternative embodiments, the mounting flange 98 and the locating member 114 can be separate parts brazed, welded, or otherwise fixedly secured to the body 66. While this may be a more expensive way to manufacture the cups 50, 54, there would still be benefits to having the mounting flange 98 and the locating member 114 fixed to or unitized with the cups 50, 54. In yet other embodiments, only one of the mounting flange 98 or the locating member could be integrated with the cups 50, 54.

Figure 8:
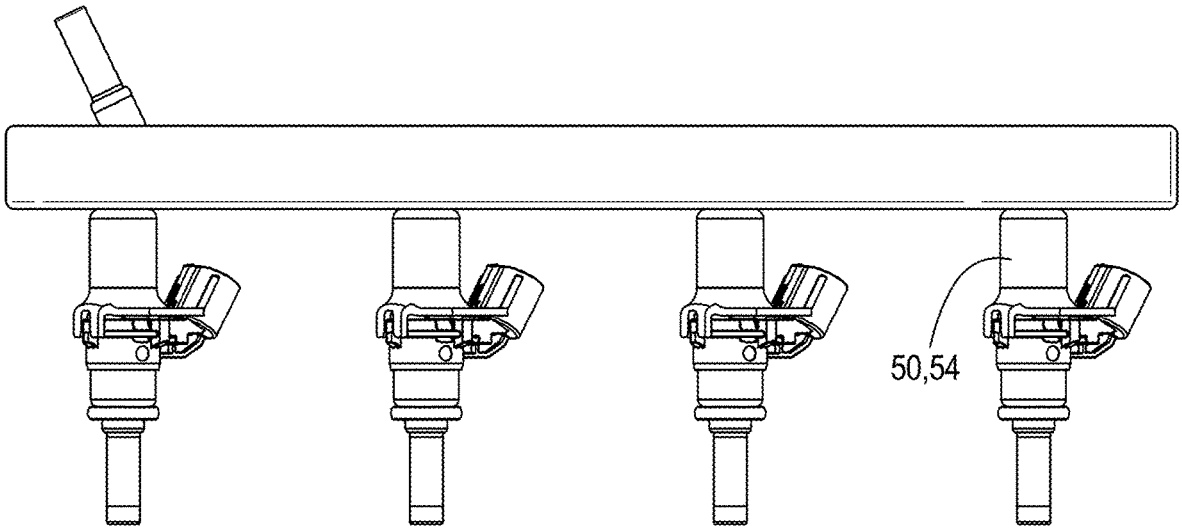
FIG. 8 is a plan view of the injector cups engaged with a more conventional fuel rail.

As shown in FIG. 8, the inventive injector cups 50, 54 can also be used with a conventional fuel rail. FIG. 9 illustrates another alternative injector cup 150, with like parts given like reference numerals increased by one hundred. The injector cup 150 differs from the injector cups 50, 54 as it includes a flange F adjacent the enlarged first opening 174. This flange F can be included to provide material where the cup 150 can be laser-welded or otherwise secured to a more conventional fuel rail (such as that shown in FIG. 8). The illustrated flange F has a uniform width and thickness around the circumference of the body 166, and extends from the outer surface of the body 166 in a generally perpendicular manner. The features and geometry of this cup 150 have been discussed above in regard to various aspects that it has in common with the cups 50,54.

Various aspects of the invention are set forth in the following claims.

What is claimed is:

1. A fuel injector cup comprising:

a body having a first opening configured to receive fuel into the body and a second opening configured to receive a fuel injector for dispensing fuel, wherein the body is generally cylindrical in shape and defines an interior cavity having a cavity diameter;

a mounting flange coupled with the body and extending therefrom, the mounting flange configured to be connected to a support surface to secure the cup to the support surface, wherein the mounting flange is adjacent the second opening and includes an aperture for receiving a fastener therethrough for securing the cup to the support surface; and a locating member coupled with at least one of the body or the mounting flange, the locating member configured to engage the fuel injector when received in the body and to orient and prevent rotation of the fuel injector relative to the body;

wherein the body, the mounting flange, and the locating member are integrally formed as one piece.

2. The fuel injector of claim 1, wherein the first opening has a diameter smaller than the cavity diameter and smaller than a diameter of the second opening.

3. The fuel injector cup of claim 1, wherein the fuel injector cup is made of stainless steel.

4. The fuel injector cup of claim 1, wherein the mounting flange is planar and extends in a plane perpendicular to a longitudinal axis of the body.

5. The fuel injector cup of claim 1, wherein the locating member includes at least one projection extending in a direction parallel to a longitudinal axis of the body and away from the second opening.

6. The fuel injector cup of claim 5, wherein the locating member includes two projections extending in the direction parallel to a longitudinal axis of the body and away from the second opening, the two projections spaced apart from one another to define a gap therebetween, the gap configured to receive a portion of the fuel injector.

7. The fuel injector cup of claim 1, wherein the locating member is adjacent the second opening.

8. The fuel injector cup of claim 1, wherein the body includes a tapered portion adjacent the second opening.

9. The fuel injector cup of claim 8, wherein the mounting flange and the locating member extend from the tapered portion away from the body.

10. The fuel injector cup of claim 9, wherein the tapered portion and the mounting flange together define a compound curvature.

11. The fuel injector cup of claim 1, wherein the cup includes a hose barb coupled directly to the body.

12. A fuel system comprising:

a fuel manifold;

a hose having a first end coupled to the manifold;

a barb coupled to a second end of the hose; and the fuel injector cup of claim 1, coupled to the barb.

13. The fuel system of claim 12, wherein the barb is part of a barb block.

14. The fuel system of claim 12, wherein no clip is used to secure the fuel injector to the fuel injector cup.

15. The fuel injector cup of claim 1, wherein the body and the interior cavity define and share a longitudinal axis.

16. A fuel injector cup comprising:

a generally cylindrical body having a first opening configured to receive fuel into the body and a second opening configured to receive a fuel injector for dispensing fuel, the body defining an interior cavity having a cavity diameter such that the first opening has a diameter smaller than the cavity diameter and smaller than a diameter of the second opening;

a mounting flange integrally formed with the body and extending therefrom at a location adjacent the second opening, the mounting flange including an aperture for receiving a fastener therethrough for securing the cup to a support surface; and a locating member integrally formed with at least one of the body or the mounting flange, the locating member configured to engage the fuel injector when received in the body and to orient and prevent rotation of the fuel injector relative to the body.

17. The fuel injector cup of claim 16, wherein the locating member includes two projections extending in the direction parallel to a longitudinal axis of the body and away from the second opening, the two projections spaced apart from one another to define a gap therebetween, the gap configured to receive a portion of the fuel injector.

18. The fuel injector cup of claim 16, wherein a packaging ratio is defined as a ratio of a smallest box in which the fuel injector cup can be contained to the cavity diameter, and is 1300 $mm^3$/mm to 1400 $mm^3$/mm.

19. The fuel injector cup of claim 16, wherein the mounting flange is planar and extends in a plane perpendicular to a longitudinal axis of the body, and wherein a distance L from the longitudinal axis to a centerline of the aperture is less than 20 mm.

* * * * *